United States Patent [19]

Korshunov

[11] 4,034,589

[45] July 12, 1977

[54] MILL FOR ROLLING CONTINUOUSLY CAST INGOT

[76] Inventor: Evgeny Alexeevich Korshunov, pereulok Otdelny, 5a, kv. 29, Sverdlovsk, U.S.S.R.

[21] Appl. No.: 730,364

[22] Filed: Oct. 7, 1976

[30] Foreign Application Priority Data

Oct. 15, 1975 U.S.S.R. ..... 2177704

[51] Int. Cl.[2] ..... B21B 13/22; B21B 35/00

[52] U.S. Cl. ..... 72/214; 72/249; 164/270

[58] Field of Search ..... 72/214, 208, 209, 193, 72/249; 164/270

[56] References Cited

U.S. PATENT DOCUMENTS

| | | | |
|---|---|---|---|
| 3,821,889 | 2/1974 | Sahsagansky et al. | 72/249 |
| 3,982,416 | 9/1976 | Pozsgay et al. | 72/214 |

*Primary Examiner*—Milton S. Mehr

*Attorney, Agent, or Firm*—Lackenbach, Lilling & Siegel

[57] ABSTRACT

A rolling mill comprising a movable mill stand mounted in slideways and enclosing grooved mill rolls whose necks are coupled with a hydraulic drive and with gear wheels in mesh with each other. A drive for reciprocating said movable mill stand is equipped with at least two linear inductors installed immovably and at least two electrically conductive bars connected rigidly to movable mill stand separators and braces. The bars are adapted to move intermediate of said inductors and have a length exceeding that of said inductors and begin of a value of at the maximum transfer of said movable mill stand. By establishing inductive currents and, hence, electromagnetic forces in the bars pulling or pushing forces acting on said movable mill sand sufficient to provide a requisite roll force. The mill roll hydraulic drive is an auxiliary one.

5 Claims, 6 Drawing Figures

MILL FOR ROLLING CONTINUOUSLY CAST INGOT

The present invention relates to metallurgy and more particularly to mills for rolling a continuously cast ingot, referred to hereinafter as a continuous casting, said mill being preferably adaptable for cogging said casting whose motion alternates with standstills.

Known in the art are rolling mills adapted for direct rolling of a continuous casting.

These mills include multiple-stand continuous mills, as well as pendulum and planetary rolling mills.

Said mills for direct rolling of a continuous casting have extensive application, provided the casting is being continuously withdrawn from a mould.

Where a need arises for rolling a continuous casting whose motion alternates with standstills, the use of said mills is practically inexpedient. In this case their power requirements increase substantially with a rather small mill utilization factor varying within 10–30%.

In our case, adopted as a prototype is a rolling mill adapted preferably for rolling a continuous casting whose travel alternates with standstills.

Patents for said mill are pending in Great Britain (No. 55740, Feb. 30, 1974), Canada (No. 186549, Nov. 23, 1973), U.S. Pat. (No. 422071, Dec. 5, 1973, for a method, the number of the patent application for a mill being yet unknown).

Said mill comprises slideways which are mounted on a foundation and along which a movable mill stand travels, said movable mill stand incorporating a bottom- and a top-mill separator and two housings each having two braces between which are installed roll chocks with bearings in which are mounted grooved mill rolls with necks. Said roll necks carry gear wheels in mesh with racks whose ends are coupled with connecting rods of hydraulic cylinders fixed on the housing braces. Apart from the hydraulic drive adapted for rotating the mill rolls, said mill is provided with another which ensures reciprocation of the movable mill stand.

Rolling of a continuous casting on said mill is effected with the movable mill stand reciprocating and being displaced after each working stroke towards a casting unrolled portion until the sum of said displacements is equal to the length of the casting extracted from a mould over a withdrawal period. After that the movable mill stand is displaced towards a rolled casting portion over a distance amounting to said sum of the displacements, the rolling process being continued after the next portion of the casting has been extracted from the mould.

Said rolling mill permits efficient rolling of a continuous casting, whose motion alternates with standstills, by comparatively small roll forces, thus limiting to a certain extent the mill production rate. If the mill drive rating is increased with the ensuing enhancement of the roll force, a higher rolling rate will result, but the arrangement of said more powerful drive on the housing braces of the movable mill stand presents a problem.

The main object of the invention is to provide a mill for rolling a continuous casting, which would develop a substantially greater, as compared with the prior-art mills, roll force by making use of a mill roll drive of the same rating.

Another object of the invention is to provide a more powerful mill, as compared with the prior-art machines, along with reduction in the weight of its movable components.

Said and other objects are achieved by providing a mill for rolling a continuously cast ingot, referred to hereinafter as a continous casting, said mill being preferably adaptable for cogging the casting whose motion alternates with standstills, and comprising a movable mill stand with drive rolls whose supports are arranged in the apertures of braces of two housings interconnected by mill separators, said movable mill stand being installed in slideways running parallel to the axis of rolling, and a drive for reciprocating the movable stand.

According to the invention, the mill is equipped with at least two pairs of linear inductors mounted immovably, and the movable mill stand comprises electrically conductive bars coupled therewith located in a zone of influence of said inductors and having a length exceeding that of said inductors and being of a value of at least the maximum transfer of said movable mill stand.

As compared with the prior-art machines, the mill of the invention developed for rolling a continuous casting has a roll drive of a lower rating.

It is expedient that the bars be fitted with two side busbars superior in their electrical conductivity to said bars which would offer a decrease in inductor power losses.

It is also sound practice that the side busbars be hollow to pass so as to permit a coolant therethrough, which would preclude bar overheating.

It is reasonable as well that the bars have transverse slots to receive transverse busbars associated electrically with said side busbars and made of a material superior in its electrical and heat conductivity to that of the bars, a feature which would also enable the inductor power losses to be decreased and bar overheating to be avoided.

The nature of the present invention will be better understood from a consideration of a detailed description of an examplary embodiment thereof, to be had in conjunction with the accompanying drawings, in which.

Figure 1:
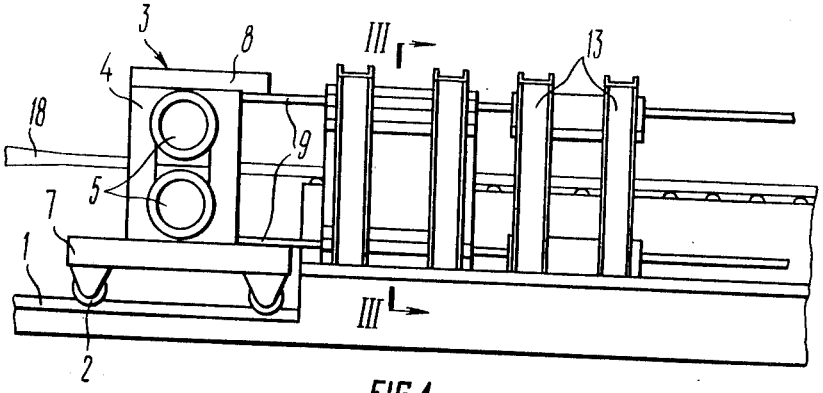
FIG. 1 shows a side view of a mill for rolling a continuous casting, according to the invention.
Figure 2:
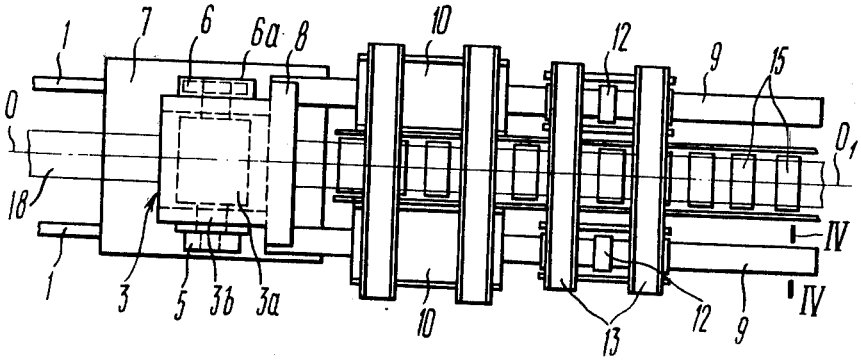
FIG. 2 shows a top view of a mill for rolling a continuous casting.

A mill comprises slideways 1 (FIGS. 1,2) mounted on supporting members embedded in a foundation (not shown in the drawing). Mounted movably on said slideways 1 on runners 2 is a movable mill stand 3 with mill rolls 3*a* whose necks 3*b* set up in chock bearings (not shown in the drawing) that are mounted in the apertures of housings 4 protrude outside the housings of said movable mill stand and from the side of one pair of housing braces are coupled with hydraulic drives 5, while from the side of the other pair of said housing braces they carry gear wheels 6 associated therewith due to a stationary fit and enclosed with a box 6*a*.

The housings 4 are mounted on a stage-separator 7 and are tied up from above by a top-mill separator 8.

Fixed rigidly to the housing braces and separators are four bars 9. The number of said bars can be either greater or less than four but not less than two.

As to the bar arrangement with respect to the movable stand and their attachment, they may vary depending on mill operating conditions and mutual arrangement of individual units and inductors on the mill.

The bars 9 connected rigidly to the movable mill stand pass through an inductor zone of influence through a space between inductors 10 mounted immovably on supporting structures 11 (FIG. 3) and then between at least two pairs of guide rollers 12 (FIG. 2) installed on metal structures 13.

The length of the bars 9 exceeds that of the inductors 10 and is of a value of at least the maximum transfer of the movable mill stand 3.

Figure 3:
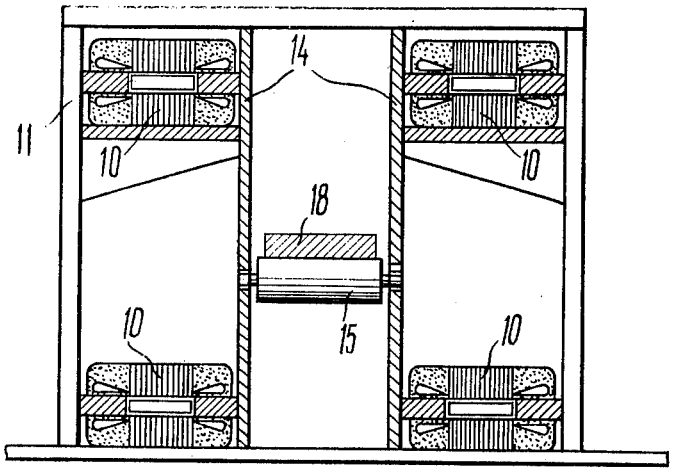
FIG. 3 is a cross sectional view the line taken along III—III in FIG. 1.

FIG. 3 shows a section taken along the direction of the length of the inductors 10, bars 9 and supporting metal structures 11. The sectional view also shows an enclosure 14 which protects the inductors from thermal radiation and which can be used as a bearing element of said supporting structure.

The distance between the interiors of each pair of said inductors correspond to the size of the cross-section of the bars 9 which in turn is determined depending on the force that must be applied to the bars and on inductor ratings.

Rollers 15 of an outgoing roll table are mounted parallel to each other along to the axis of rolling $00_1$ from the movable mill stand installed in its extreme position in immediate proximity to the inductors 10. At the beginning of said outgoing roll table a roller pulling stand (not shown in the drawing) can be mounted.

The bars 9 are produced from a electrically conductive material, such as aluminum or alloys thereof. The inductors will function more efficiently if the bars are fitted with side busbars set up on their lateral faces, the busbar material being superior in its electrical conductivity to that of the bars. Thus, if aluminum alloy or steel bars are employed, the side busbars are preferably made of copper.

Insofar as when developing under the effect of the electromagnetic forces a force acting on the bar, inductive currents are induced in said bars, and the bars are heated with the ensuring decrease in their strength. Heating can be reduced by making use of the water-cooled side busbars or of the water-cooled bars proper.

Figure 4:
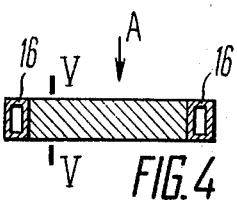
FIG. 4 is a cross sectional view the line taken along IV—IV in FIG. 2.

FIG. 4 shows a section taken along the bar 9 provided with the water-cooled side busbars 16.

Figure 5:
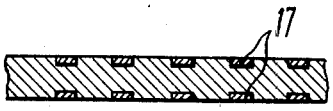
FIG. 5 is a cross sectional view the line taken along V—V in FIG. 4.
Figure 6:
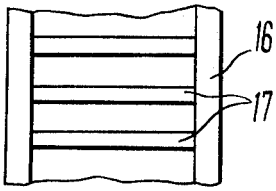
FIG. 6 is a view of FIG. 4 taken in the direction of arrow A.

The performance characteristics of the inductors 10 can be somewhat improved if, apart from said side busbars, the bar is fitted with transverse slots to receive transverse busbars 17 in a material featuring a lower electrical conductivity than that of the bars. FIG. 5 shows a section taken along the bar portion wherein said transverse busbars are clearly seen. The transverse busbars 17 are associated electrically with the side busbars 16, as shown in FIG. 6.

The cooling system of one or two side busbars can be utilized for feeding the coolant to and discharging it from the units of said movable mill stand which call for such cooling, such as mill rolls with internal drillings.

The cooling system of the other side busbars can be used for supplying working fluid into the mill roll hydraulic drives.

Under steady-state operating conditions of the proposed mill for rolling a continuous casting 18 whose motion alternates with standstills the rolling process is effected in the following manner.

After the next portion of the casting 18 has been extracted from a mould, the movable mill stand 3 is brought into a position corresponding to the assigned reduction of the casting during the working stroke of said movable mill stand 3. Said operation is accomplished (with the grooved mill rolls 3*a* brought out of contact with the rolled casting) by moving the movable mill stand 3 by means of the forces developed by the electromagnetic forces established in said bars by 9 the inductors 10 and applied to said bars 9.

Next the hydraulic drive 5 or the mill rolls 3*a* is actuated and gives them at first a slight idle turn, whereupon the rolls grip the casting. At the same time as the casting is gripped by the mill rolls, the inductors 10 are switched over to an operating duty to displace the movable mill stand by developing in the bars 9 a pushing force, acting on the movable mill stand through said bars 9. Said pushing force developed in the bars, and the force of the mill roll drive ensure the requisite roll force that is required for reducing the casting rolled portion by shifting the movable mill stand towards a casting unrolled portion.

Upon reducing the casting rolled portion and after the mill rolls have come out of contact with the casting 18, one or two inductors 10 shift the movable stand 3 towards the casting unrolled portion over a distance corresponding to the casting reduction degree during the next working transfer of said movable mill stand. After that the hydraulic drive 5 reverses the mill rolls and gives them at first a slight idle turn, whereafter, upon gripping the casting with the rolls, the next reduction cycle is initiated. At the same time as the casting is being gripped with the rolls, the inductors 10 establish by means of the bars 9 a pulling force applied to the movable mill stand and, thus, by displacing said stand towards the casting rolled portion owing to the force, developed by the mill roll drive, and the pulling force, developed by means of the bars, provide the requisite roll force.

After the next reduction of the casting the movable stand is again brought by means of one or two inductors into a position corresponding to the assigned reduction of the casting during the working stroke of the movable mill stand. Following that the cycle is repeated until the rolled casting is equal in length to that extracted from the mould during the withdrawal period.

Upon reducing the casting to a prescribed length, the movable mill stand is brought by means of one or two inductors 10 and the bars 9 to its initial extreme position towards the casting rolled portion, the rolling process being recommenced after the next portion of the casting has been extracted from the mould.

The static inductors as well as the pulling or pushing bars allow the developing of a relatively powerful mill with the movable mill stand enclosing a roll drive of a comparatively small rating.

As compared with the prior-art machine, the hereinproposed mill offers a substantial reduction in inertia masses of the movable members of the mill (movable mill stand) and in energy consumption for their recoprocation.

What we claim is:

1. (Amended) A mill for rolling a continuously cast ingot, said mill rolling the ingot intermittently, [and] comprising: a movable mill stand mounted on slideways running parallel to the axis of rolling [;], said stand having a [carriage] *stage-separator* set up on said slideways; [a pair of] housings each of which is provided with [two] braces, said housings being fixed on said [carriage] *stage-separator*; a top-mill separator interconnecting said housings; grooved mill rolls arranged [between] *inside* said housings, roll necks *of said grooved mill rolls* protruding [with their tail ends] outside said braces; hydraulic driving means mounted on the braces of said housings and coupled to said roll necks [and projecting from] *which project beyond* a side of [one] *a* pair of said braces; gearing means meshing with each other and fitted on said roll necks [projecting from] *which project beyond* a side of [the other] *another* pair of said braces; a drive adapted for reciprocating said movable mill stand, said drive being equipped with static linear inductors installed in proximity to a zone of displacement of said movable mill stand, and with at least two electrically conductive bars connected rigidly to said movable mill stand, said bars being disposed in a zone of influence of said inductors and having a length exceeding that of said inductors.

2. A mill of claim 1, wherein said bars are fitted with two side busbars which are greater in their electrical conductivity than are the bars.

3. A mill of claim 2, wherein said side busbars are provided with passage means for a coolant.

4. A mill of claim 2, wherein said bars are fitted with transverse slots to receive transverse busbars associated electrically with said side busbars and made from a material having greater electrical and heat conductivity than the material of the bars.

5. The mill of claim 1, wherein the length of said bars is of a value of at least the maximum travel of said stand.

* * * * *